United States Patent [19]

Colvin

[11] 4,406,105

[45] Sep. 27, 1983

[54] STRUCTURAL GLASS ASSEMBLIES

[75] Inventor: John B. Colvin, Lancashire, England

[73] Assignee: Pilkington Brothers Limited, St. Helens, England

[21] Appl. No.: 177,472

[22] Filed: Aug. 12, 1980

[30] Foreign Application Priority Data

Aug. 17, 1979 [GB] United Kingdom ..... 7928807

[51] Int. Cl.[3] ..... E04B 1/38

[52] U.S. Cl. ..... 52/285

[58] Field of Search ..... 52/582, 403, 285, 208, 52/509, 394; 49/352

[56] References Cited

U.S. PATENT DOCUMENTS

| | | | |
|---|---|---|---|
| 561,339 | 6/1896 | Pollard | 52/394 |
| 642,105 | 1/1900 | Ganter | 52/285 |
| 646,601 | 4/1900 | Hasek | 52/582 |
| 824,964 | 7/1906 | Vaughan | 52/582 |
| 910,655 | 1/1909 | Fells | 52/285 |
| 924,703 | 6/1909 | Streed | 52/285 |
| 2,107,141 | 2/1938 | Colt | 52/509 |
| 2,595,111 | 4/1952 | Steward | 52/582 |
| 2,939,186 | 6/1960 | Norwood et al. | 52/208 |
| 3,281,991 | 11/1966 | Colell | 49/352 |

FOREIGN PATENT DOCUMENTS

| | | | |
|---|---|---|---|
| 294790 | 4/1932 | Italy | 52/582 |

*Primary Examiner*—James L. Ridgill, Jr.
*Attorney, Agent, or Firm*—Joel M. Freed

[57] ABSTRACT

A structural glass assembly in which one or more glass plates are secured by an attachment device to an adjacent element, the attachment device comprising a plate member partially overlying an edge region of the glass plate on one side only thereof and extending parallel to the plane of the plate so as to form a connection between the glass plate and the adjacent element, the plate member being spaced from the glass plate and secured to the edge region of the plate so as to permit the edge region to flex inwardly or outwardly when subjected to load.

8 Claims, 3 Drawing Figures

STRUCTURAL GLASS ASSEMBLIES

BACKGROUND OF THE INVENTION

The present invention relates to structural glass assemblies including, for example, suspended glass assemblies and fittings therefor.

One type of structural glass assembly is known as a suspended glass assembly. A suspended glass assembly may consist of a matrix of specially processed and tempered glass plates bolted together at their corners by means of small metal fittings. The joints between the glass plates are usually sealed with a silicone sealant and tempered glass stabilisers are used at each vertical joint to provide lateral stiffness against wind loading. The assembly is usually constructed in situ suspended from a building structure by hangers bolted along its top edge and can be sealed to the building in peripheral channels.

Hitherto it has been considered necessary to use fittings comprising spaced metal plates which overlap in parallel relationships so as to clamp the corners of four adjacent glass plates in the assembly between the metal plates, the overlapping area of glass and metal serving to support the glass plates. Typically known fittings include a flat brass plate which can be bolted to four corner regions of adjacent glass plates with the flat brass plate lying flat against the outerside of the glass assembly. At the same time, two substantially L-shaped plates are located on the other side of the glass assembly one limb of each L-shaped plate being bolted to the corner regions on the inner side of the adjacent glass plates while the other limbs of each L-shaped plate are arranged to sandwich between them a glass stabiliser which extends perpendicular to the face of the suspended assembly.

We have found that whilst such known types of fitting apparently support the corners of the glass plates and strengthen the structure, stronger glass assemblies, whether they be suspended or otherwise, can be produced by avoiding sandwiching the corners of the glass plates between metal plates. The sandwiching of the corners of the glass plate may restrict the extent to which the corners can flex when high wind loads act on the glass assembly. Such restriction can cause high stress in the corners of the glass plates and this can give rise to constraints on the areas of glass plates which can be safely used in such glass assemblies.

SUMMARY OF THE INVENTION

The present invention provides a structural glass assembly in which a glass plate is secured by means of an attachment device to an adjacent element which is spaced from an edge of the glass plate, said attachment device comprising a plate member partially overlying an edge region of the glass plate on one side only thereof and extending parallel to the plane of the glass plate so as to form a connection between the glass plate and the adjacent element, said plate member being spaced by spacer means from said one side of the glass plate and secured to the edge region of the glass plate so as to permit the edge region to flex inwardly or outwardly relative to the plate member when the glass plate is subjected to load.

Preferably the plate member is flexible so as to minimise resistance to flexing of the edge region of the glass plate when subjected to load. The degree to which the glass plate will flex relative to the flexible plate member is dependent on the relative flexibility of the glass and flexible plate member.

The invention is particularly applicable to a structural glass assembly in the form of a suspended glass assembly comprising a matrix of suspended glass sheets.

Normally suspended glass assemblies comprise glass plates that are coplanar and joined together at their corners. They may include stabilising members comprising vertically extending glass plates lying perpendicular to the plane of the matrix and having vertical edges adjacent vertical junctions in the matrix.

In a suspended glass assembly the aforesaid adjacent element may comprise one or more glass plates in the matrix of glass plates.

Alternatively the adjacent element may comprise part of a frame or other building structure to which the glass plate is attached. In this case the supporting structure is not generally made of glass but can be of any structural material, for example, brick or concrete, having sufficient strength to take the reactive load from the glass plate.

The invention includes a suspended glass assembly in which two coplanar glass plates are joined together by an attachment device comprising a plate member partially overlying an edge region of each glass plate on one side only if the glass plates and extending parallel to the glass plates and forming a connection between them, the plate member being spaced by spacer means from the said one side of the glass plates and secured to the edge regions of the glass plates so as to permit the edge regions to flex inwardly or outwardly relative to the plate member when the glass plates are subjected to wind load.

The invention includes a suspended glass assembly as aforesaid in which four adjacent coplanar glass plates are arranged with one corner of each of the glass plates forming a common junction with the other three plates, said four glass plates being similarly joined together by the said plate member.

The suspended glass assembly may include more than four coplanar glass plates, each junction of four plates being provided with an attachment device as aforesaid.

Preferably the plate member used in the present invention is secured to the adjacent glass plate or plates by bolts passing through holes in the plate member and in the edge regions, usually the corners, of the glass plates.

The attachment device preferably includes means for attaching the plate member to stabilising means for stabilising the matrix of glass plates in a direction perpendicular to the plane of the matrix.

The stabilising means may comprise one or more glass plates extending perpendicular to the plane of the matrix.

Preferably the means for attaching the plate member to the stabilising means comprises a link member having means for attachment to an edge of a stabilising glass plate and means for attachment to the plate member at a position intermediate the connections of the plate member to each of the glass plates in the matrix. Preferably the means for attachment to an edge of a stabilising glass plate comprises two plates bolted together on opposite sides of the stabilising glass plate.

Preferably the link member is attached to the centre of the plate member.

Conveniently the glass plates in the matrix are bolted to the plate member and non-metallic gaskets and bushes are inserted to prevent metal to glass contact.

The plate member is preferably sufficiently flexible to allow the glass plates to flex so as to avoid undue concentration of stresses in the corner portions of the glass plates. On the other hand the flexible plates must be made of a material that has dimensions with sufficient strength to resist the wind loading forces.

Preferably the flexible plate member is manufactured from a material which when tested in accordance with the procedure set out in a publication issued by the British Standard Institution entitled "BS18 "Tensile Testing of Metals: Part 2-Steel": 1971", has a lower yield stress greater than 350 $MN/m^2$. Some suitable materials may not exhibit a lower yield of stress and when tested in accordance with the procedure set out in the above publication exhibit a 0.5% total elongation proof stress which is greater than 350 $MN/m^2$. Conveniently the material used for the flexible plate is steel, preferably a steel of grade 080A52 as specified in the publication "BS970 "Specification for Wrought Steels": Part 5 "Carbon and Alloy Springs Steels for the Manufacture of hot Formed Springs": 1972" as issued by the British Standard Institution.

Advantageously the steel of grade 080A52 is quenched and tempered prior to use so as to increase its lower yield stress to over 1000 $MN/m^2$. The steel can, for example, be quenched from 840° C. and tempered at 400° C.

Advantageously the thickness of the flexible plate member is less than 12 mm as thicknesses above 12 mm tend to restrict the flexibility of the plate.

The present invention also provides an attachment device for use with glass assemblies, in which the device comprises a flexible plate manufactured from a material having a lower yield stress or a 0.5% total elongation proof stress, greater than 350 $MN/m^2$, means for connecting the flexible plate to the corner portion or portions of a glass plate or plates and means for connecting the flexible plate to a supporting structure.

Conveniently the device has means which can be fitted to the centre of the flexible plate and which is adapted to receive an edge region of a glass stabilising plate. The attachment is so adapted that the glass stabiliser can be arranged in a plane which passes through the vertical joints defined between glass plates in a suspended glass assembly.

DESCRIPTION OF THE PREFERRED EMBODIMENTS

Figure 1:
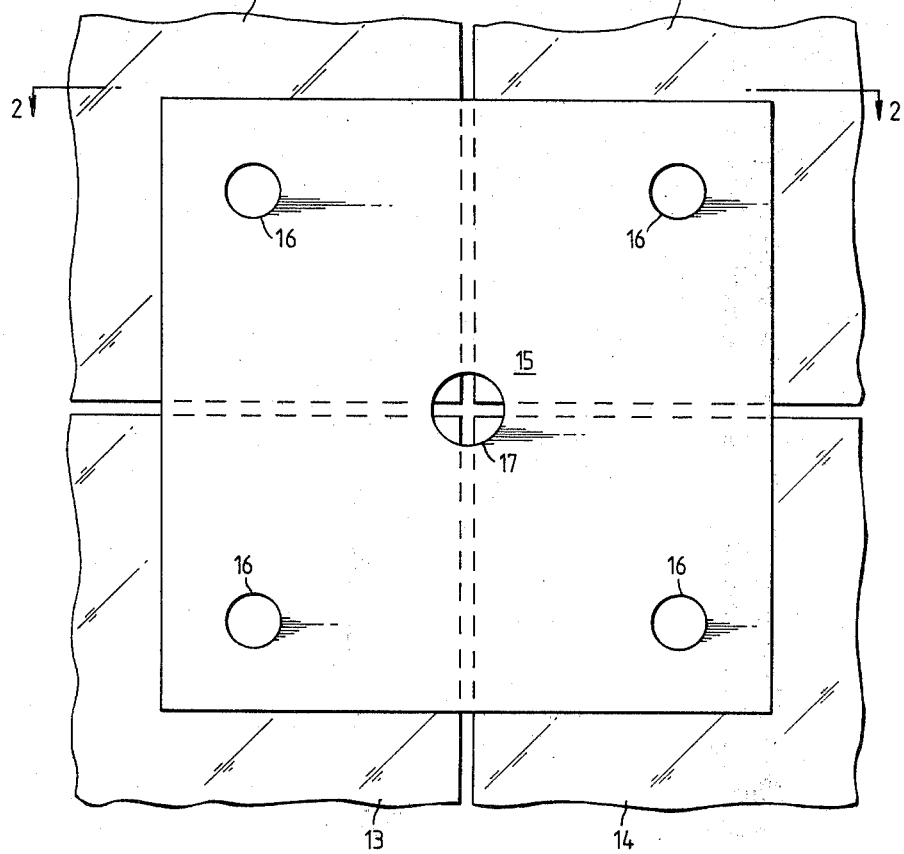
FIG. 1 is a side view of a junction of four glass sheets in a suspended glass assembly with an attachment device, in accordance with the present invention, prior to attachment.
Figure 2:
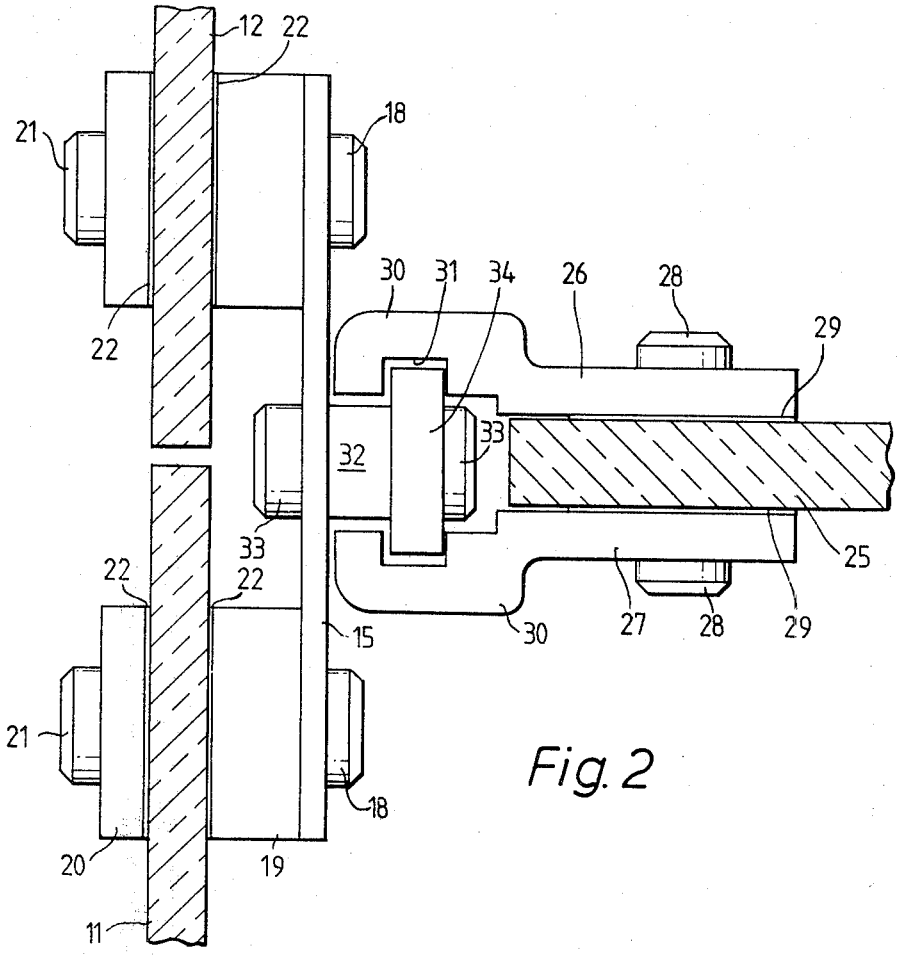
FIG. 2 is a section on the line 2—2 in FIG. 1 after attachment.

The example of FIGS. 1 and 2 relates to a suspended glass assembly of the type in which a matrix of tempered glass plates is hung from a building structure and sealed together to form a glass facade. In such an assembly, the matrix may include many glass plates forming a plurality of vertical and horizontal rows of glass plates. The glass plates are arranged so that the corners of four adjacent plates meet at a common junction as is shown in FIG. 1. The plates are coplanar and spaced apart by a small distance, for example 5 mm. The corners of each plate of a set of four which meet at a common junction are secured together by an attachment device and FIGS. 1 and 2 illustrate the construction and attachment of such a device at one junction in the assembly. It will be understood that similar attachment devices may be coupled at other junctions of the glass plates in the assembly.

In the arrangement shown in FIG. 1, four tempered glass plates 11, 12, 13 and 14 meet at a common junction where they are secured together by an attachment device in the form of a flat rectangular plate 15. The plate in this example comprises a 6 mm thick flexible planar plate manufactured from spring steel having a lower yield stress greater than 350 $MN/m^2$. The plate partially overlies an edge region of each glass plate and is formed with four bolt holes 16 each arranged to overlie a corner region of one of the glass sheets. The plate is also formed with a central aperture 17. The plate 15 is arranged to lie parallel to the inner face only of the matrix of glass plates and no similar attachment device is provided on the outer surface of the matrix of glass plates. In FIG. 1, the plate 15 is shown in position but not yet attached to the glass plates. The manner of attachment is shown fully in FIG. 2.

The plate 15 is bolted to each of the glass plates 11, 12, 13 and 14 by a bolt 18 passing through the respective aperture 16 in the plate 15 and through an aligned hole in the corner region of the associated glass plate. An aluminium washer or boss 19 is located between the plate 15 and each of the glass plates. A further aluminium washer or boss 20 is inserted between each of the glass plates and the head 21 of each of the bolts on the outer face of the matrix of glass sheets. A gasket 22 of rubber, plastics material, or other non-metallic material is inserted between each of the washers 19 and 20 and the adjacent glass surfaces so as to prevent metal to glass contact.

Also a bush (not shown) is located around the central portion of each bolt 18 to separate that bolt 18 from the glass plate through which it passes.

As the four corner regions are held together by only the one flexible plate 15, the corner portions of the glass plates are substantially free to flex when the matrix of glass plates is subjected to wind load.

It is customary in suspended glass assemblies to provide stabilisers in the form of glass sheets which extend vertically along a vertical junction in the matrix of glass sheets. The sstabilising glass sheets are arranged perpendicular to the plane of the matrix so that they resist deflection of the matrix in a direction perpendicular to its plane. Such a stabilising glass plate is indicated by the reference numeral 25 in FIG. 2. It will be understood that a number of such stabilising plates may be provided in the suspended glass assembly at suitable vertical junctions in the matrix. FIG. 2 shows the manner in which the stabilising plate 25 is secured to the plate member 15. The plate 25 is sandwiched between two metal plates 26 and 27. The plates 26 and 27 are bolted together by means of bolts 28 passing through apertures in the plates 26 and 27 as well as an aligned aperture in the glass plate 25. Gaskets 29 made of rubber, plastics material or other non-metallic material are inserted between the plates 26 and 27 so as to prevent glass to metal contact. Bushes (not shown) located around bolts 28 separate the bolts 28 from the plate 25. The plates 26 and 27 have at their ends adjacent the plate member 15, coupling members 30 each having a recess 31. A hollow aluminium extrusion 32 is located adjacent the central part of the plate member 15 and is secured thereto by a doubleheaded bolt 33 which passes through the central aperture 17 in the plate member 15. The aluminium extrusion 32 carries a projecting member 34 the outer ends of which engage the recesses 31. In this way, the plates 26 and 27 are attached to the plate member 15. The glass stabiliser 25 will normally be secured to a supporting structure at some position along its height to resist displacement when the suspended glass assembly is subjected to wind load.

Figure 3:
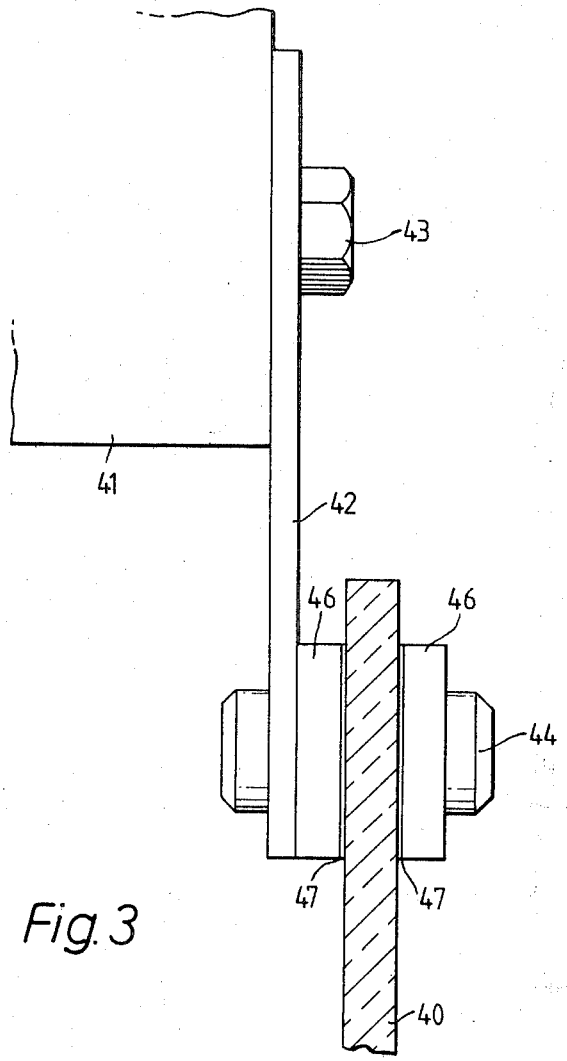
FIG. 3 shows in elevation a structural assembly in which a glass plate is connected to a building structure in accordance with the present invention.

FIG. 3 shows an alternative embodiment in which a glass plate 40 is secured to a frame member 41 forming part of an adjacent building structure which may be made of any suitable building material. In this case, an upper edge region of the plate 40 is secured to the frame member 41 by an attachment device in accordance with the present invention. The attachment device includes a plate member 42 similar to the plate member 15 already described with reference to FIGS. 1 and 2. The flexible plate member 42 is bolted to the frame member 41 by a bolt 43. The lower edge of the plate member 42 has an aperture aligned with a corresponding aperture in the upper edge of the plate 40. A bolt 44 passes through the aligned apertures and thereby secures the upper edge of the glass sheet 40 to the plate member 42. An aluminium washer 46 is located between the glass sheet 40 and the plate member 42 and a similar aluminium washer 46 is located between the outer head of the bolt 44 and the outer face of the glass sheet 40. Gaskets 47 of rubber, plastics, or other non-metallic material are inserted between the washers 46 and opposing faces of the glass sheet 40 so as to prevent metal to glass contact. Bushes (not shown) separate the glass sheet 40 from the region of the bolt 44 which passes through the glass sheet 40.

The attachment device shown in FIG. 3 is similar to that referred to in FIGS. 1 and 2 in that the use of a single flexible plate member on one side only of the glass sheet enables the glass sheet to flex under wind load. The plate member 42 is formed of similar materials to those already referred to. It will be appreciated that in the arrangement shown in FIG. 3, the plate member 42 may be attached to any suitable edge region of the glass sheet 40 and may again be used adjacent corner regions when desired. It may also be used to attach a glass plate to any adjacent building structure with various relative orientations of both the glass sheeet and the adjacent building structure.

The invention is not limited to the details of the foregoing examples. For instance, the aluminium washers referred to in both the examples may be replaced by stainless steel, mild steel or brass washers. The shape of the washers can be rectangular, circular or of any other desired shape.

I claim:

1. A suspended glass assembly in which two coplanar glass plates are joined together by a plate member partially overlying an edge region of each glass plate on one side only of the glass plates and extending parallel to the glass plates and forming a connection between them, the parallel plate member being spaced by spacer means from said one side of the glass plates and secured to the edge regions of the glass plates, the spacer means being disposed relative to the edges of the glass plates so as to provide gaps between the parallel faces of the edge regions of the glass plates and the plate member, the plate member being attached to a stabilizing means for stabilizing the glass plates in a direction perpendicular to the plane of the glass plates, the stabilizing means and the gaps between the parallel faces of the edge regions of the glass plates and the plate members together permitting the edge regions of the glass plates to flex substantially freely relative to the plate member when the glass plates are subjected to wind load.

2. A glass assembly as claimed in claim 1 in which the plate member is flexible.

3. A suspended glass assembly according to claim 1 in which four adjacent coplanar glass plates are arranged with one corner of each of the glass plates forming a common junction with the other three plates, said four glass plates being joined to said plate member, a corner region of each of the glass plates being joined in spaced relationship to part of the plate member which overlies the glass plate on one side only so as to allow flexing when subjected to wind load.

4. A suspended glass assembly including a plurality of groups of four sheets, each group of four being connected as an assembly claimed in claim 3.

5. A glass assembly according to claim 1 in which the plate member is secured to the or each glass sheet by a bolt passing through said spacer means.

6. A glass assembly according to claim 5 in which each bolt is provided with means to prevent metal to glass contact.

7. A glass assembly according to claim 1 in which means for attaching the plate member to the stabilizing means comprises a link member having means attached to an edge of a stabilizing glass plate and means attached to the plate member at a position intermediate the connections of the plate member to each of the glass plates.

8. A glass assembly according to claim 7 in which said means attached to an edge of a stabilizing glass plate comprises two plates bolted together on opposite sides of the stabilizing glass plate.

* * * * *